US006926468B2

(12) United States Patent
Sehl

(10) Patent No.: US 6,926,468 B2
(45) Date of Patent: Aug. 9, 2005

(54) PORTABLE FLOTATION PLATFORM FOR SHALLOW BODIES OF WATER

(76) Inventor: James Francis Sehl, R.R. 2 Box 119, St. James, MN (US) 56081

( * ) Notice: Subject to any disclaimer, the term of this patent is extended or adjusted under 35 U.S.C. 154(b) by 0 days.

(21) Appl. No.: 10/615,269

(22) Filed: Jul. 8, 2003

(65) Prior Publication Data

US 2004/0009043 A1 Jan. 15, 2004

Related U.S. Application Data

(63) Continuation-in-part of application No. 10/191,245, filed on Jul. 9, 2002, now Pat. No. 6,648,554.

(51) Int. Cl.[7] ..... B63B 35/00; B63C 1/00

(52) U.S. Cl. ..... 405/219; 405/204; 405/218; 441/35; 114/45; 114/351

(58) Field of Search ..... 405/1, 3, 4, 196, 405/198, 203–205, 218, 219, 229; 114/45, 357, 263–265, 351–353; 5/706, 709; 441/35, 45

(56) References Cited

U.S. PATENT DOCUMENTS

| | | | | | |
|---|---|---|---|---|---|
| 2,455,408 | A | * | 12/1948 | Daniels | 108/4 |
| 3,646,895 | A | * | 3/1972 | Campbell | 108/118 |
| 4,040,585 | A | * | 8/1977 | Socas | 248/676 |
| 4,070,980 | A | * | 1/1978 | Shorter, Jr. | 114/263 |
| 4,099,656 | A | * | 7/1978 | Neumann et al. | 294/157 |
| 5,158,332 | A | * | 10/1992 | Goulter et al. | 294/146 |
| 5,239,940 | A | * | 8/1993 | Griffin | 114/353 |
| 5,588,782 | A | * | 12/1996 | Haring | 405/218 |
| 5,681,272 | A | * | 10/1997 | Lee | 602/32 |
| 6,173,671 | B1 | * | 1/2001 | Casull | 114/345 |
| 6,230,644 | B1 | * | 5/2001 | Passen et al. | 114/263 |
| 6,374,763 | B1 | * | 4/2002 | Hartman | 114/263 |
| 6,648,554 | B1 | * | 11/2003 | Sehl | 405/219 |
| 2003/0042075 | A1 | * | 3/2003 | Bench | 182/115 |

* cited by examiner

*Primary Examiner*—Jong-Suk (James) Lee
(74) *Attorney, Agent, or Firm*—Carl Rowold

(57) ABSTRACT

A portable flotation platform is disclosed for use in supporting a load of equipment, hunting dogs, or personnel above the level of a body of water. The platform includes a deck constructed to be of an overall density less than that of water and sized so as to support the load above the level of the water. An anchor extends down to the bottom of the water and up to the deck to hold the deck on station in the water. The deck is provided with a carrying attachment to facilitate the user carrying the deck to a point of deployment at the water. The deck further has anchor storage for carrying the anchor along with the deck to the point of deployment.

3 Claims, 7 Drawing Sheets

PORTABLE FLOTATION PLATFORM FOR SHALLOW BODIES OF WATER

RELATED PATENT APPLICATION

This application is a continuation in-part of U.S. patent application Ser. No. 10/191,245, filed Jul. 9, 2002 now U.S. Pat. No. 6,648,554.

BACKGROUND OF THE INVENTION

This invention relates to portable flotation platforms, and more particularly to platforms adapted to be deployed in shallow bodies of water for supporting relatively light loads, such as equipment, hunting dogs and personnel, above the level of the body of water.

Duck hunters hunting in wetland areas having shallow bodies of water typically rely on dogs to retrieve the fowl that they down. When the hunter is in a boat, the dogs can stand-by in the boat with the hunter, but this is often not desirable and a better place for the dogs at the hunt is needed. When the bodies of water are shallow enough to allow the hunter to stand but not for the dogs to do so, the dogs must stand-by on firm ground, which is not always available nearby, or the dogs must keep themselves afloat in the water which is exhausting and perhaps even dangerous to the dogs. Again a better place for the dogs to stand-by is needed.

Similarly, fishermen, environmentalists and park personnel frequenting wetlands with shallow bodies of water need to support their respective equipment above the level of the water. In some areas, the use of a boat, even a small boat or canoe, is not practical because of the shallow depth of the water or because excessive portage of the boat would be required. In a manner similar to hunters seeking a better place for their dogs on trips to the wetlands, these users of the wetlands seek a better place for their equipment.

Further, people working in wetlands, such as directional drillers when drilling generally horizontal wells or bores for pipelines or other utilities, need a temporary platform above the water to facilitate their work. The platform for these workers as well as for hunters and fishermen need to be large enough to support their personal weight, but light weight, easy to deploy and inexpensive.

SUMMARY OF THE INVENTION

Among the features of the invention is the provision of a portable flotation platform which may be carried by the user to and from the wetlands point of deployment, either directly by being carried by the user to the point or indirectly by being carried by the user to a boat for transport the remaining distance to the point of deployment. Another feature is the provision of a platform for the support of a load of equipment or hunting dogs above the water level in a generally stationary position.

More particularly, a portable flotation platform is disclosed for supporting a load, such as a load of equipment or hunting dogs, above the level of a body of water. The platform includes a deck constructed to be of an overall density less than that of water and presenting a rigid upper member for carrying the load above the water level. An anchor is provided as part of the platform which when deployed engages the bottom of the body of water to hold against movement across the bottom and extends up toward the surface of the water. The deck has at least one connector for detachably securing the deck to the anchor to prevent horizontal movement of the deck. A carrying attachment is provided on the deck for enabling a user to carry the platform to and from a point of deployment at the body of water, preferably in a manner similar to a back pack.

Among other features of the invention are an anti-skid upper surface to prevent movement of the load across the deck, an interior storage chamber in the deck for housing the anchor when not in use, an adjustable length anchor to accommodate bodies of water of differing depths and a stop detachably secured on the anchor to limit upward movement of the deck, such as might otherwise occur with wave action on the body of water.

Further features of this deck include light weight to facilitate the user carrying this deck to a point of deployment, via backpack type straps, a handle or wheels at one end of the deck for larger, personal sized embodiments of the invention. The deck further features anchor storage for carrying the anchor along with the deck either in an interior storage chamber in the deck, or at the exterior of the deck. A back-pack type bag may be provided to facilitate carrying the deck. A boat attachment device secures the deck against horizontal movement relative to a boat, while allowing vertical movement of the deck.

Other features and advantages will be in part described and in part apparent from the following figures and descriptions.

BRIEF DESCRIPTION OF THE DRAWINGS

Corresponding elements and reference numbers are the same among the various figures of the invention.

DETAILED DESCRIPTION OF AN EXEMPLARY EMBODIMENT

Figure 1:
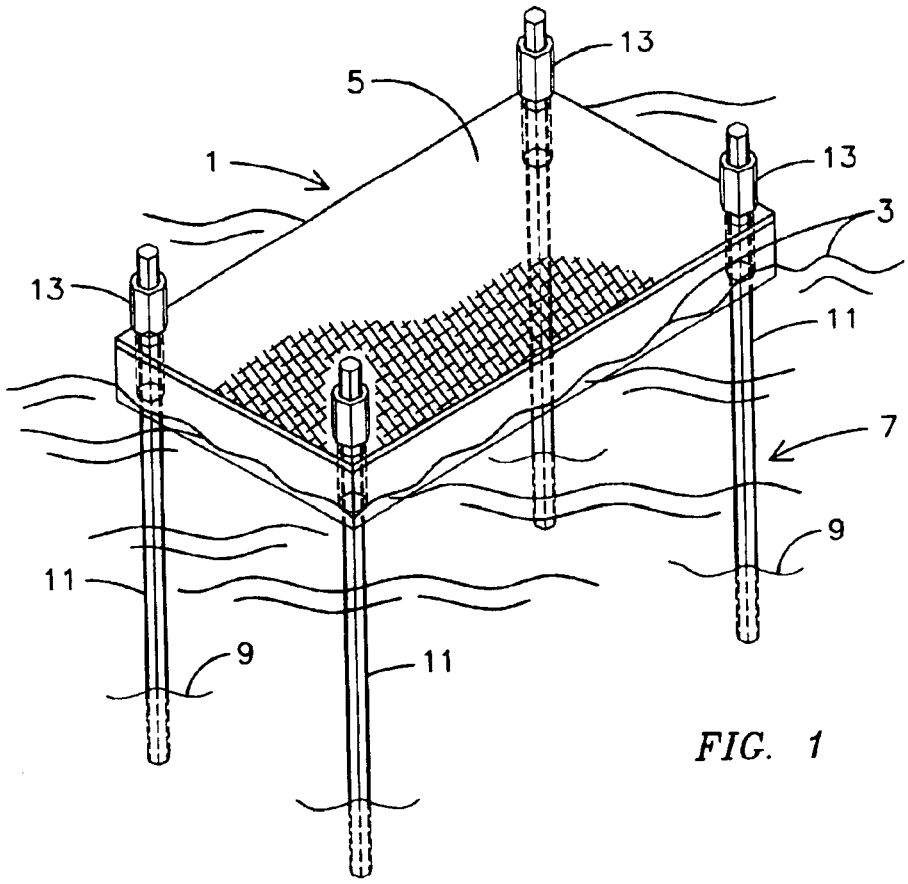
FIG. 1 is a perspective view of the platform of this invention as deployed in a body of water, but with certain components removed from this view for greater clarity of the relationship of the deck and anchor to the body of water.

Referring to FIG. 1 of the drawings there is generally indicated at 1 a preferred embodiment of this invention for supporting a load of equipment, hunting dogs or personnel (not shown) above the level of a shallow body of water 3. Hunting dogs often accompany hunters on a hunting trip to wetlands or lakes having one or more shallow bodies of water. When the water is so shallow that a hunter can stand on the bottom, the water may still be too deep to enable the dogs to do so. The platform 1, when deployed as shown in FIG. 1, provides a suitable structure for supporting the dogs slightly above the water level. As described hereinafter, the platform may be installed in relatively deep bodies of water (i.e., too deep for a hunter to stand and thus requiring a boat for the hunters) and yet provide a suitable structure to support the hunting dogs, or to be installed relative to a boat.

The equipment positioned on the platform may include not only hunting and fishing equipment, but also other wetlands related equipment, such as water quality monitoring equipment for environmentalists and state agencies. Indeed, as described hereinafter, the platform is sized so and so constructed that it may support any number of different types of live or dead loads, up to weights of approximately between 70 to 100 pounds for smaller size decks and 180 pounds or more for larger size decks for supporting a hunter, fisherman or other personnel. Further, as also described in detail herein, the platform may be carried by users to and from a point of deployment at the body of water directly by the user or indirectly by the user to a boat, and be readily deployed on site. For smaller size decks, the user may carry the deck via a handle to a boat or via backpack straps directly to the point of deployment at the body of water. For larger size decks, the platform may be carried by the user via wheels and handles on the deck.

As shown in FIG. 1, the platform comprises a deck 5 constructed to be of an overall density less that that of water so as to float on the water, and an anchor of suitable design, such as indicated generally at 7, engagable with the bottom 9 of the body of water and the deck for holding the deck on station in the water against horizontal movement. The preferred anchor is shown as comprising poles 11 extending down into the bottom 9 of the body of water and up above the surface of water 5. Four poles are shown as being provided, one at each corner of the deck, but a greater or lesser number of poles may be provided and be positioned at other points at the interior or the exterior of the deck, while remaining within the scope of this invention. Stops 13 may be detachably secured to the poles 11 at desired locations on the poles to prevent upward movement of the deck 5 beyond the stops. Thus, the deck may be held down by the stops some distance below the level that the deck would otherwise occupy in the water 3 to bias the deck up against the stops, and thus hold the deck stable against vertical movement when waves on the surface of the water hit the platform or as loads are placed on or removed from the deck.

Figure 2:
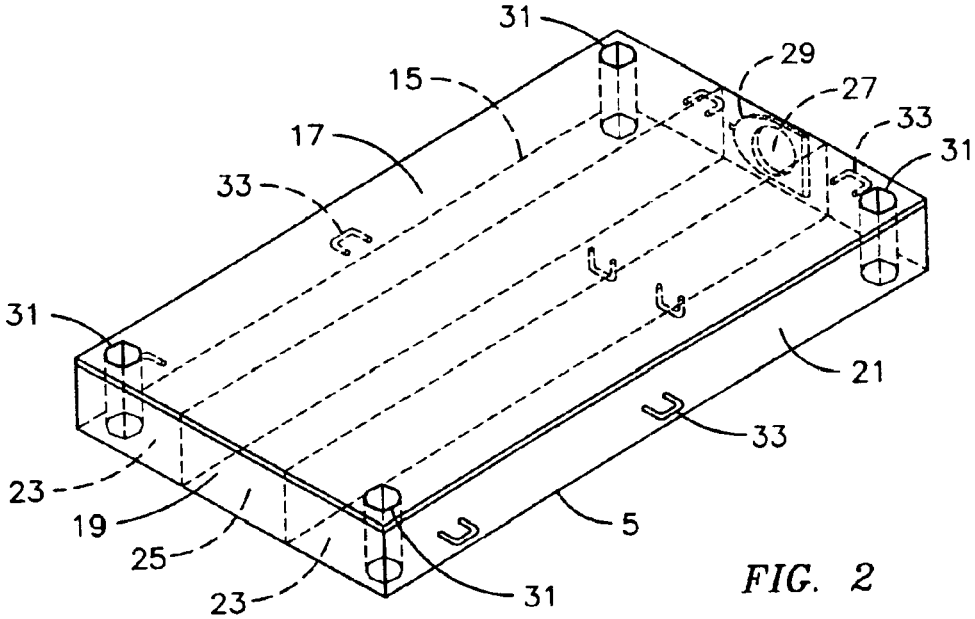
FIG. 2 is a perspective view of the deck with certain components removed from this view for greater clarity of the interior construction details of the deck.

As best illustrated in FIG. 2, the deck 5 is of generally box-like construction having a bottom 15, an upper member 17, as well as opposed ends 19 and sides 21 extending between the bottom and upper member. These members are formed of pieces of suitable thermoplastic sheets and are secured together along their edges by suitable primary or secondary bonding. The deck may be made by other suitable fabrication or molding processes, such as a so-called roto-casting process in which plastic beads are positioned within a mold in the shape of the deck, with the mold then heated, rotated and cooled to form a single, unitary molded product in the final shape of the deck. In its interior, the deck has at least one buoyancy chamber 23 (and as shown in FIG. 2, two such buoyancy chambers) filled with a suitable plastic foam material, such as Styrofoam, to reduce the effective density of the deck. The deck may also have an interior storage chamber 25 for housing the anchor poles 11 when not in use to facilitate transporting the poles with the deck. The chamber 25 extends the length of the deck and is sized to receive all of the poles. An opening 27 in the end of the deck at the chamber provides access to the chamber for positioning the poles in and withdrawing the poles from the chamber. A cap 29 with a hinge or other suitable tether to the end 19 of the deck and a latch selectively closes the opening to hold the poles in place in the chamber during transit as well as to keep water out while the deck is in use. As described more fully hereinafter, the deck may also be formed without the incorporation of an interior anchor storage chamber, but rather with an anchor storage at the exterior of the deck. Further, the deck may be formed using a void in lieu of plastic foam at its interior as part of the buoyancy chambers, and to use the entire interior cavity of the deck as a single large buoyancy chamber.

Suitable anchor connectors 31 to the anchor poles 11 are provided on the deck, such as short lengths of plastic tubing secured at each of the four corners of the deck. The openings or apertures of the connectors 31 are sized to receive the anchor poles 11 in sliding engagement to enable the anchor to hold the deck on station against horizontal movement while enabling vertical movement of the deck up and down on the anchor poles with changes in water level or deck loading. Attached at the exterior of the deck are a series of generally U-shaped brackets 33 for attachment of back-pack type carrying straps 35, and a decoy bag 37 as more fully described below.

Figure 8A:
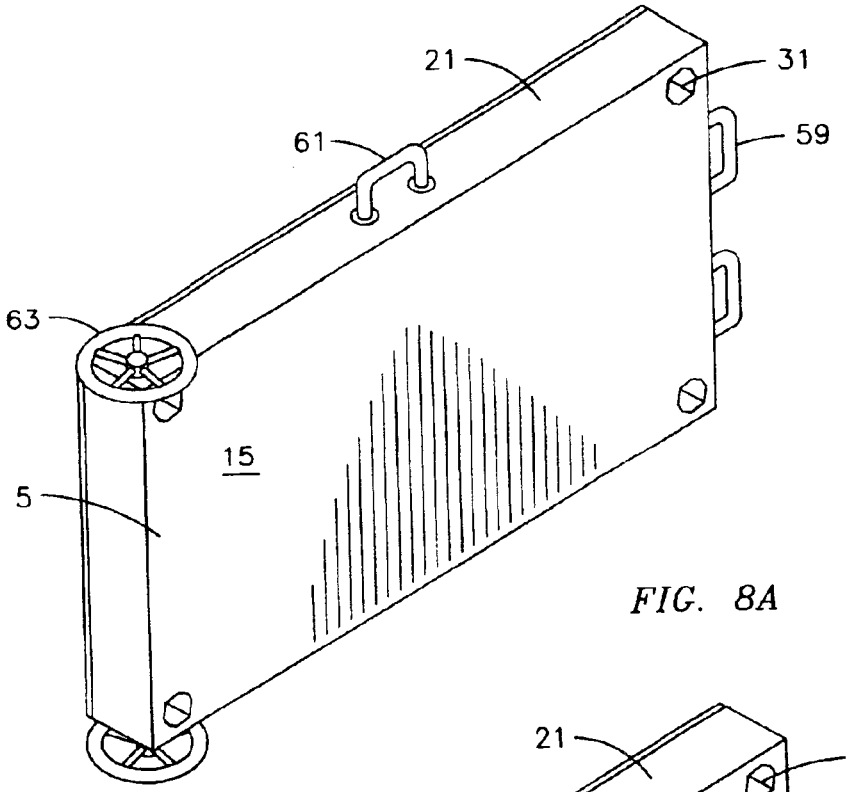
FIG. 8A is a perspective view of an alternative embodiment of the deck showing handles at an end and a side of the deck, as well as wheels at the other end of the deck.

Overall the smaller size deck is preferably approximately 36" long, 20" wide, and 4' thick and weights approximately 18 pounds, including the anchor poles. So constructed, the deck may be carried, preferably like a back-pack, to the site of use. The deck may also be carried like a suitcase via handles (such as handles 59, 65 or 67 described below) to a boat for deployment. Once the platform 1 is deployed, the deck 5 provides sufficient size to able equipment or a dog to remain stable on the upper surface, and sufficient buoyancy to support this load. Alternatively, as described more fully hereinafter, the deck may be of a larger size up to 6" (or thicker) and approximately 48" long (or longer) and approximately 30" wide (or wider) so as to provide enough buoyancy as to support the weight of a person. So constructed, the deck may weigh 40 pounds or more. This would make carrying the deck on the user's back more difficult. As shown in FIG. 8A one or more wheels and/or handles may be provided to facilitate the user carrying the deck to the point of deployment or t a boat for deployment at the water, either directly or indirectly by the user carrying the deck to a boat.

Figure 3:
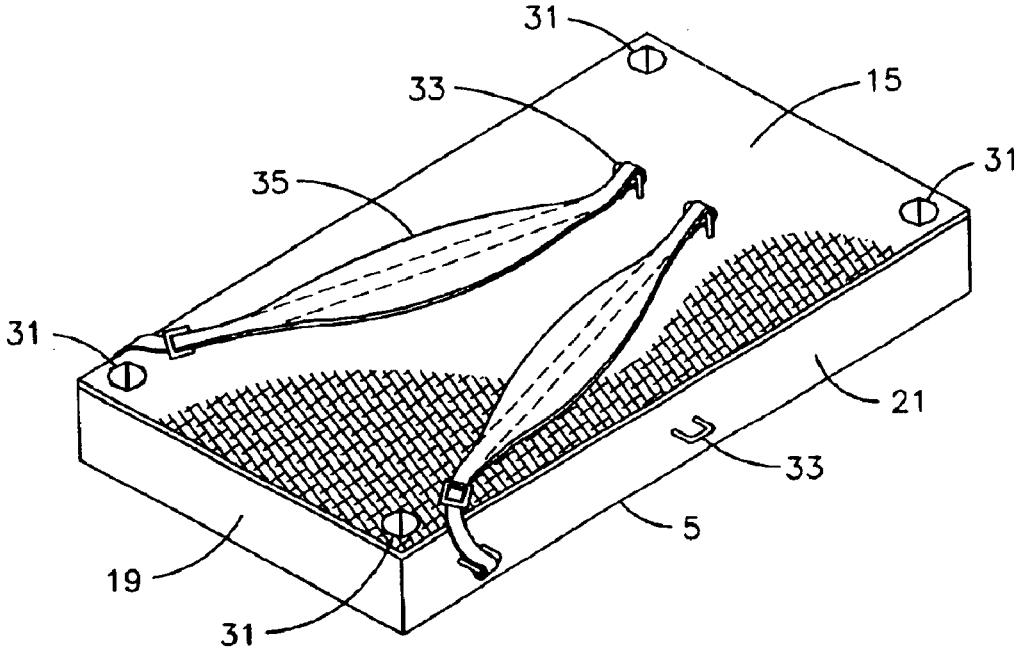
FIG. 3 is a perspective view of the bottom of the deck with carrying straps attached.

FIG. 3 shows the bottom 15 of the deck, with a carrying attachment in the form of two carrying straps 35 at opposite sides of the bottom. Each strap is secured at its lower end to a bracket 33 at the side 21 of the deck and at its upper end to a bracket 33 at a generally central region of the bottom of the deck. A fastener on the carrying strap enables adjustment of the effective length of the strap between its upper and lower ends to fit the size of the user. The straps may also include clasps (not shown) detachably securing the straps to the deck for enabling easy removal of the straps from the deck, such as when the platform is deployed.

Figure 4:
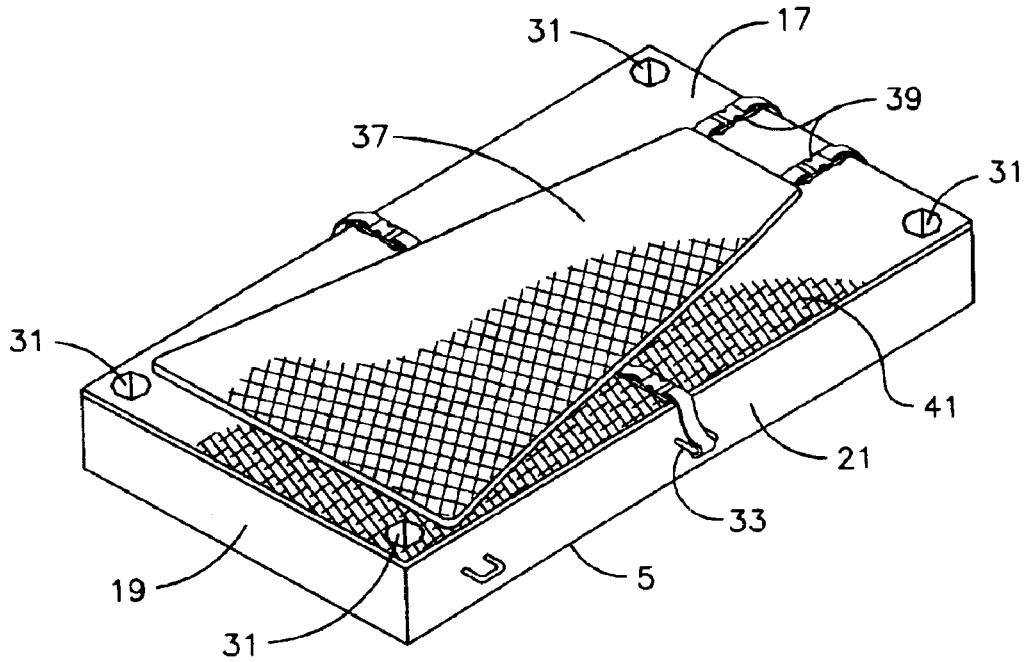
FIG. 4 is a perspective view of the top or upper member of the deck with a decoy bag attached.

FIG. 4 shows the upper member 17 of the deck, with a decoy bag 37 detachably secured over the upper surface. The decoy bag is preferably of mesh construction and is attached by a series of straps to brackets 33 at the sides and an end of the deck. Clasps 39 are provided on each strap to enable removal of the decoy bag when the deck is deployed, thereby exposing the surface of the upper member. This surface is preferably of a suitable anti-skid construction, such as outdoor carpeting 41 bonded to the upper member, to prevent the unintended movement of the load (such as that of a dog or equipment) across the deck.

Figure 5:
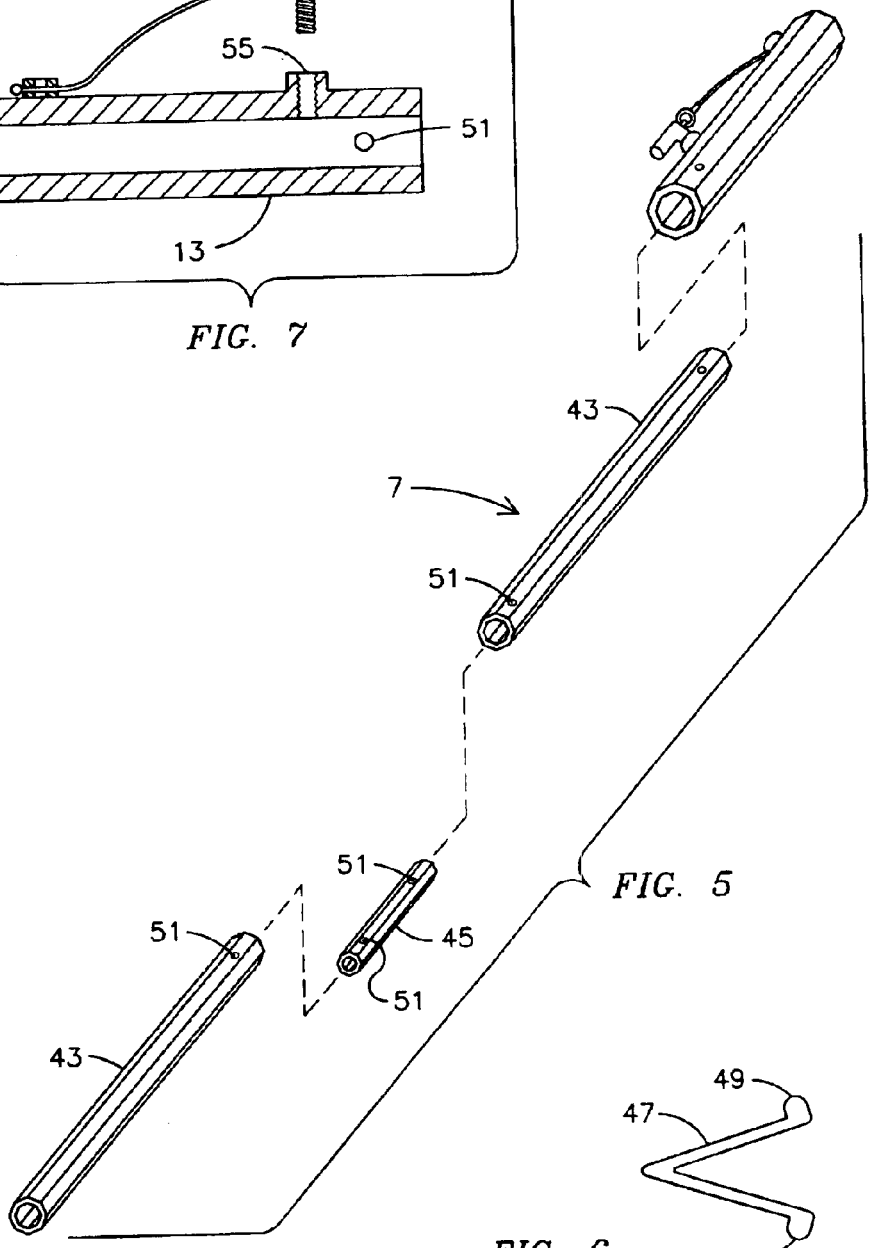
FIG. 5 is an exploded view of an anchor pole showing two pole segments and a connector to be telescoped between the segments.

As shown in FIG. 5, the anchor 7 preferably comprises a pole of extensible length, which in turn comprises one or more pole segments 43 detachably secured together. More particularly, the pole segments are formed of a suitable tubing such as aluminum tubing slightly shorter than the length of the deck 5. The pole segments are detachably secured together by a connector 45, such as a short length of tubing, telescoped within one end of the pole segment. The tubing connector 45 is positioned wholly within the pole segment 43 when not in use to connect pole segments to facilitate positioning the pole segments in the deck anchor storage chamber 25. Alternative forms of anchor storage are shown in FIGS. 9A–9D for storing the anchor at the exterior of the deck when the anchor is not in use.

Figure 6:
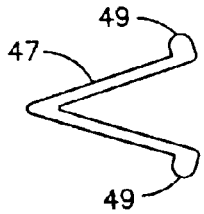
FIG. 6 is a side view of a spring clip forming part of the anchor pole connector for detachably securing the pole segments together.

To connect the pole segments, the tubing connector is moved to a position extending approximately one half of its length beyond the end of the tubing segment. A suitable fastener is provided at each end of the tubing connector, such as the spring clip 47 shown in FIG. 6 received in the connector. Each spring clip has a pair of arms biased outwardly to a position wider than the tubing connector and has a lateral projection 49 at the end of each arm. The tubing and the pole segments have holes 51 extending there through that register when the pole segments are connected end-to-end over the tubing connector 45. In this position, the projections 49 on the spring clip are moved out under the spring bias through the corresponding holes 51 to secure the pole segments together. Preferably, the pole segments are of non-circular section, such as octagonal as shown in FIG. 5, to facilitate bringing the holes and spring clips into register. Disassembly of the pole segments can be effected by manually depressing the projections 49 on the spring clips, such as by finger pressure, while applying force to pull the post segments 43 away from each other.

Figure 7:
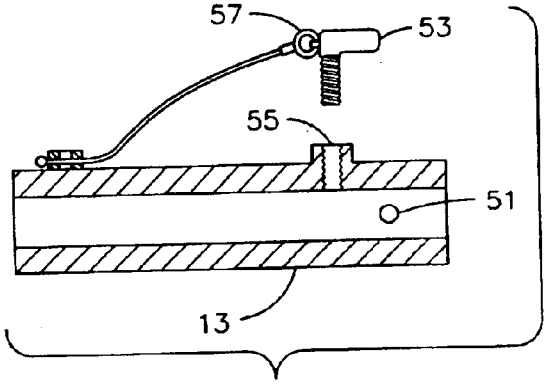
FIG. 7 is a longitudinal section of a stop to be positioned on an anchor pole.

As shown in FIGS. 5 and 7, the stop 13 is constructed of tubing of generally the same sectional shape as the anchor poles 11, but of slightly larger size than the anchor poles 11 and the apertures in the anchor connectors, so to act as a collar in sliding engagement along the pole and as a point of contact with the deck to limit upward movement of the deck. The stop has a fastener, such as the L-shaped bolt 53 threaded into a threaded bore 55 opening to the interior of the stop. The bolt when threaded into the bore projects into engagement with the pole segment to set the collar in the desired position on the anchor pole. A tether 57 secured at one end thereof to the bolt 53 holds the bolt attached to the stop at times when the bolt is not threaded in the bore, such as during storage of the anchor poles. Similarly, the stop may be provided with a hole and the pole provided with a spring clip 47 to hold the stop on the tubing during storage.

In the use of the platform 1 of this invention, the deck, with the anchor poles 11 in the storage chamber and the decoy bag 37 preferably attached, is carried by the user by the handles to a boat or on the user's back using the carry straps 35 to the point of deployment of the platform in the wetlands or shallow lakes. The user then removes the anchor poles from the deck. If the water depth requires that the anchor poles be of extended length, a suitable number of segments are assembled together by use of the tubing connectors 45. The anchor poles are then positioned in the body of water 3 so as to extend down through one or more of the anchor connectors 31 in the deck and penetrate the bottom 9 of the body of water. Stops 13 may then be positioned on the anchor poles and set in position by means of bolt 53 to engage the deck and hold it partially depressed in the water to make the deck more stable in a vertical direction. With the platform thus deployed as shown in FIG. 1, a load of equipment or a dog may be supported on the deck. Disassembly of the platform 1 for transport away from the site of deployment may be effected by reversing the steps described above.

Figure 8B:
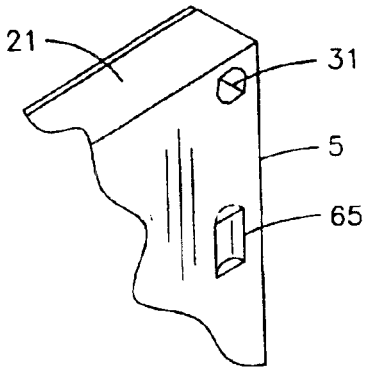
FIG. 8B is a perspective view of one corner of an alternative embodiment of the deck showing a handle integrally formed as a recess in the deck.
Figure 8C:
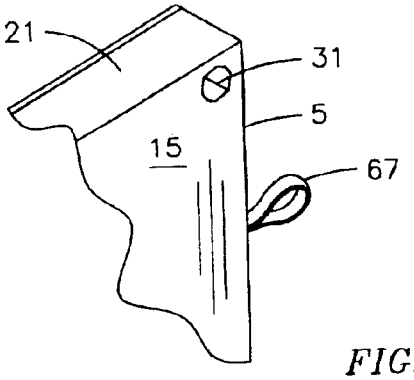
FIG. 8C is a perspective view of the deck showing a handle in the form of a strap.

Referring to FIG. 8A, an alternative embodiment of the deck 5 is illustrated having a suitable hand attachment device on the deck for enabling a user to lift and carry the deck to the point of deployment at the body of water either directly or indirectly via a boat or other means of transport. The device may comprise a rigid handle fixedly secured to and projecting from the exterior of the deck, such as handles 59 at the end of the deck, or a handle pinned to the deck, such as a handle 61 pinned to the side of the deck. The device may also take the form of a recess, such as recess 65 in FIG. 8B formed in the exterior of the deck sized and shaped to enable a person to readily grasp the deck via the recess. A further alternative of the handle is shown in FIG. 8C to comprise a strap of flexible material 67 attached to the deck. For carrying larger size decks, the handles may be used in conjunction with one or more wheels provided on the deck. Two such wheels 63 are shown in FIG. 8A at opposed corners of the deck, with the wheels projecting down below the plane of the bottom of the deck to provide ground clearance. The wheels are pinned to the deck for rotation about a horizontal axis when rolling the deck over the ground, with the handle being at the opposite end of the deck.

Figure 9A:
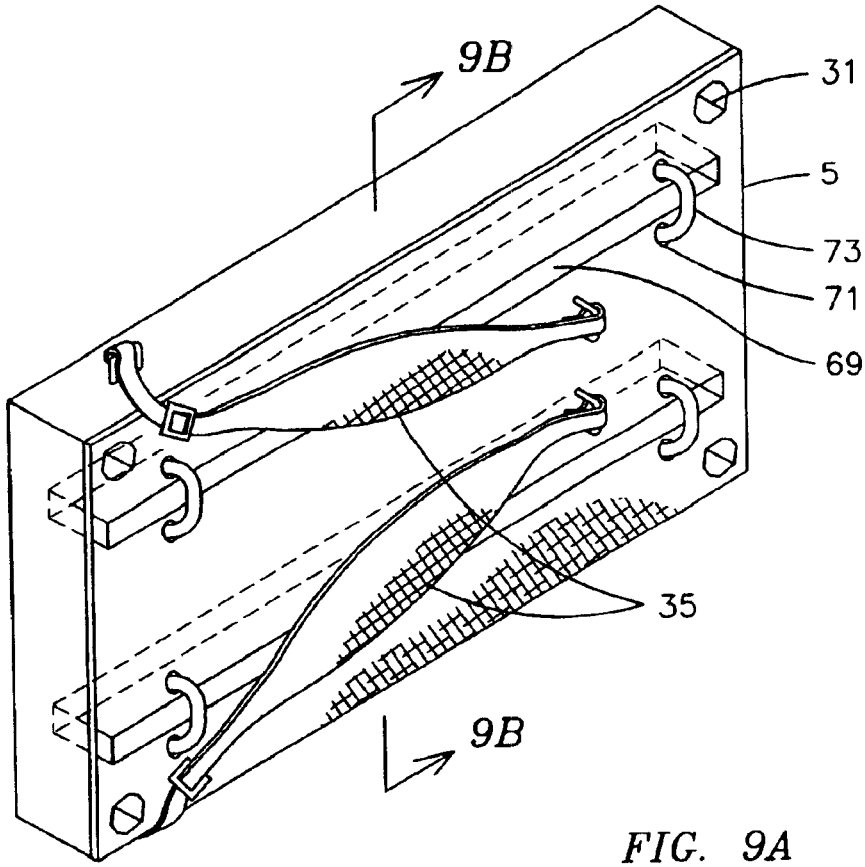
FIG. 9A is a perspective view of an alternative embodiment of the deck showing anchor storage at the bottom of the deck.
Figure 9B:
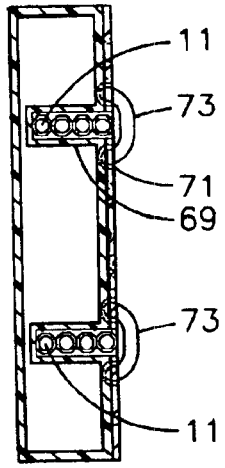
FIG. 9B is a section view of the deck along line B—B of FIG. 9A showing anchor poles in the anchor storage recesses.
Figure 9C:
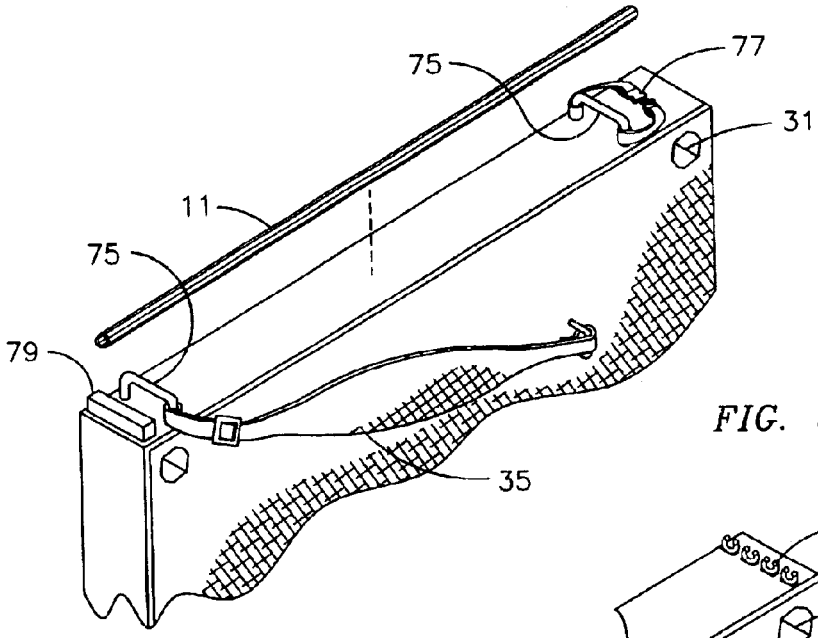
FIG. 9C is a perspective view of a further alternative embodiment of the deck showing anchor storage at the side of the deck.
Figure 9D:
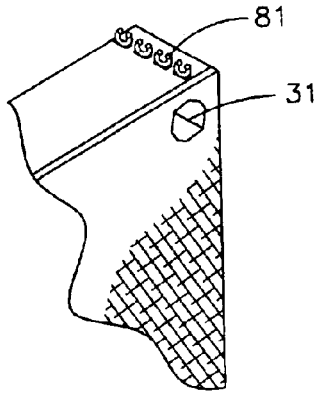
FIG. 9D is a perspective view of resilient clips at the side of the deck for anchor storage.
Figure 10:
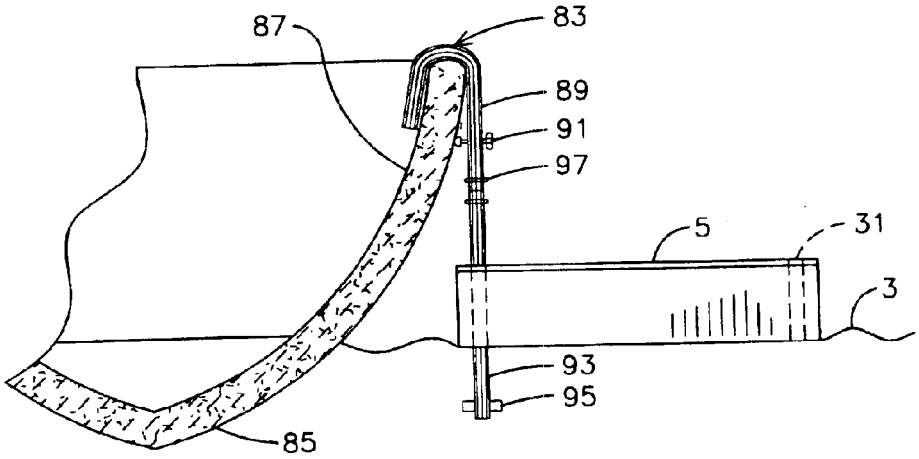
FIG. 10 is an elevation view of the deck connected by a boat attachment device to the side of a boat.
Figure 11:
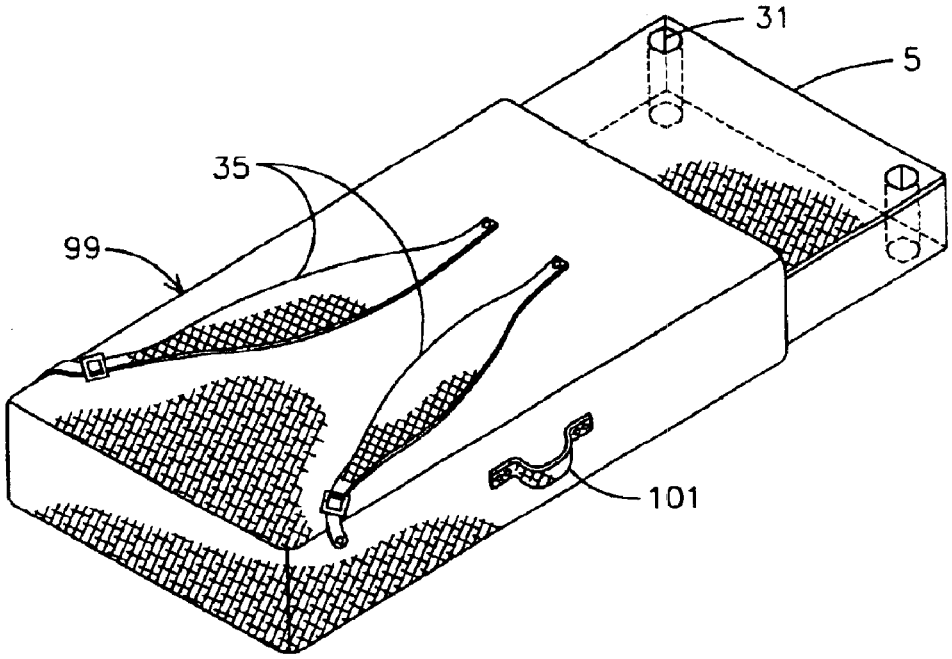
FIG. 11 is a perspective view of a backpack type bag for holding and carrying the deck.
Figure 12:
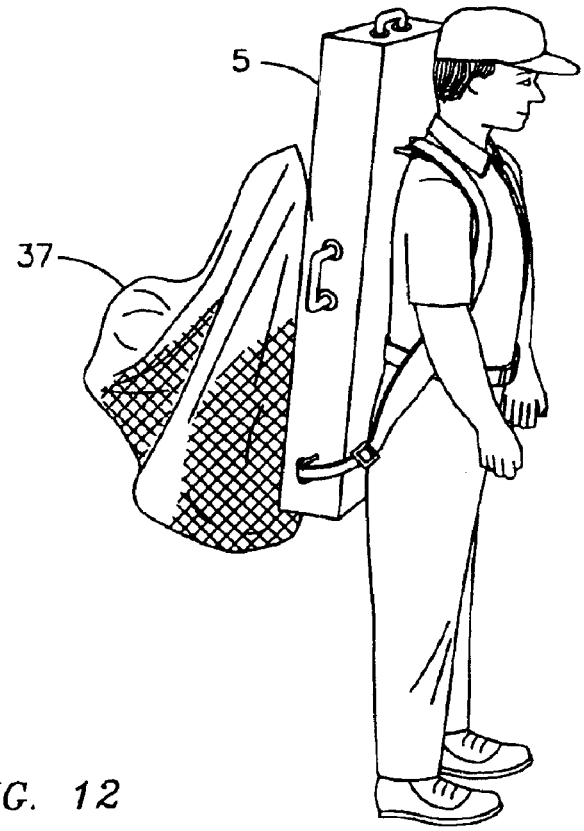
FIG. 12 is a perspective view of a user carrying the deck by backpack straps on the deck.

Alternative forms of anchor storage are shown in FIGS. 9A–9D. The anchor storage of FIG. 9A comprises one or more recesses 69 formed in the deck, such as at the bottom 15 of the deck, to be of a size and shape to receive the anchor. More particularly, the recesses are long enough to receive the anchor poles 11. A suitable closure, such as recesses 71 and straps 73 detachably secured in the recesses 71, are provided to hold the anchor in the recesses, see FIG. 9B. The anchor storage may also comprise one or more strips of material, such as strips 75, secured to the exterior of the deck in the form of a hoop so as to present apertures for receiving the anchor 11, see FIG. 9C. A stop projects from the deck in alignment with the aperture to prevent movement of the anchor poles down through the apertures when the deck is held upright. A suitable closure, such as a two-piece strap 77 secured at its ends and having a clasp, may otherwise be provided to detachably hold the anchor in its storage. The storage of FIG. 9C may also take the form of a tube or bag secured to the deck and presenting an aperture to receive the anchor. In addition, as illustrated in FIG. 9D, the anchor storage may take the form of one or more resilient, generally U-shaped clips, such as clips 81, that deform to receive and release the anchor. The deck 5 may also be configured to detachably store boat attachment devices 83 as described below.

It will be understood that one skilled in the art may make modifications of the preferred embodiment shown herein within the scope and intent of the claims of this application. While the present invention has been described in terms of a specific embodiment thereof, it is not intended the present invention should be limited thereby, but is intended to cover the invention broadly within the scope and spirit of the claims.

What is claimed is:

1. A portable flotation platform for supporting a load above the level of a body of water, the platform comprising:

a deck of overall density less than that of water and presenting a generally planar upper surface for the load, with the deck, when deployed in the body of water, being supported adjacent the surface of the water by the buoyant force of the deck in the water for supporting the load carried on the deck;

an anchor device which when deployed in the body of water and connected to the deck is engageable with a bottom of the body of water for holding the deck against horizontal movement;

the deck having at least one connector for detachably securing the deck to the anchor device for vertical movement of the deck in the water relative to the anchor; and a pack adapted to receive and releaseably hold the deck and having a carrying attachment on the pack for enabling the user to carry the deck via the pack to a point of deployment.

2. The portable flotation platform of claim 1 wherein the pack comprises a bag having an opening at an end thereof to receive the deck and the carrying attachment comprises a pair of shoulder straps on the bag.

3. The portable flotation platform of claim 1 wherein the pack comprises a bag having an opening at an and thereof to receive the deck and the carrying attachment comprises a handle on the bag.

* * * * *